US010191411B2

(12) United States Patent
Kuroiwa et al.

(10) Patent No.: US 10,191,411 B2
(45) Date of Patent: Jan. 29, 2019

(54) REMAINING TONER CONVEYING APPARATUS AND IMAGE FORMING APPARATUS

(71) Applicant: CANON FINETECH NISCA INC., Misato-shi (JP)

(72) Inventors: Ikuyo Kuroiwa, Ota-ku (JP); Yuki Nagahashi, Yokohama (JP); Akihito Yokote, Noda (JP); Hideo Nagura, Yoshikawa (JP)

(73) Assignee: Canon Finetech Nisca Inc., Misato-Shi (JP)

( * ) Notice: Subject to any disclaimer, the term of this patent is extended or adjusted under 35 U.S.C. 154(b) by 0 days.

(21) Appl. No.: 15/609,216

(22) Filed: May 31, 2017

(65) Prior Publication Data

US 2017/0351196 A1 Dec. 7, 2017

(30) Foreign Application Priority Data

Jun. 2, 2016 (JP) ..... 2016-110786

(51) Int. Cl.
*G03G 15/08* (2006.01)
*G03G 21/10* (2006.01)

(52) U.S. Cl.
CPC ..... *G03G 15/0865* (2013.01); *G03G 21/105* (2013.01)

(58) Field of Classification Search
CPC ..... G03G 15/0865; G03G 21/0005; G03G 21/105
See application file for complete search history.

(56) References Cited

U.S. PATENT DOCUMENTS

| | | | | |
|---|---|---|---|---|
| 4,870,465 | A | 9/1989 | Lindblad et al. | |
| 7,529,511 | B2 | 5/2009 | Kayahara et al. | |
| 7,835,683 | B2 | 11/2010 | Muraishi et al. | |
| 8,270,890 | B2 | 9/2012 | Arai et al. | |
| 2008/0124132 | A1* | 5/2008 | Aimoto | G03G 15/0822 399/256 |

(Continued)

FOREIGN PATENT DOCUMENTS

| | | | |
|---|---|---|---|
| JP | H02-78971 | U | 6/1990 |
| JP | 2007-298712 | A | 11/2007 |
| JP | 2009-134169 | A | 6/2009 |

(Continued)

OTHER PUBLICATIONS

Office Action dated Mar. 13, 2018, in Japanese Patent Application No. 2016-110786.

(Continued)

*Primary Examiner* — Gregory H Curran
(74) *Attorney, Agent, or Firm* — Venable LLP

(57) ABSTRACT

Provided is a remaining toner conveying apparatus including a cleaning blade which recovers a toner remaining on a surface of a photosensitive drum and a conveying screw which conveys the remaining toner so that a conveyance amount per predetermined time in a first conveyance path conveying the remaining toner recovered by the cleaning blade to a discharge portion for discharging the remaining toner is equal to or less than a conveyance amount in a second conveyance path in a downstream side in a conveyance direction where the conveyance path is narrower than the first conveyance path.

14 Claims, 10 Drawing Sheets

(56) References Cited

U.S. PATENT DOCUMENTS

| | | | | |
|---|---|---|---|---|
| 2011/0097124 | A1* | 4/2011 | Koike | G03G 21/12 399/358 |
| 2015/0268585 | A1* | 9/2015 | Kadowaki | G03G 21/105 399/358 |

FOREIGN PATENT DOCUMENTS

| | | | |
|---|---|---|---|
| JP | 2011-022534 | A | 2/2011 |
| JP | 2011-053408 | A | 3/2011 |
| JP | 2011-186137 | A | 9/2011 |
| JP | 2012-042789 | A | 3/2012 |
| JP | 2012-242638 | A | 12/2012 |
| JP | 2015-028509 | A | 2/2015 |

OTHER PUBLICATIONS

Office Action dated Jun. 19, 2018, in Japanese Patent Application No. 2016-110786.

* cited by examiner

REMAINING TONER CONVEYING APPARATUS AND IMAGE FORMING APPARATUS

BACKGROUND OF THE INVENTION

Field of the Invention

The invention relates to a remaining toner conveying apparatus provided in an image forming apparatus such as a printer, a copying machine, a facsimile machine, and the like.

Description of the Related Art

In an image forming apparatus, an electrostatic latent image is formed by exposing a surface of a photosensitive drum (image bearing member) uniformly charged by a charging device with laser beam corresponding to image information. After that, a developer (toner) is supplied to the electrostatic latent image formed on the surface of the photosensitive drum by the developing device to develop the electrostatic latent image as a toner image. Next, the toner image formed on the surface of the photosensitive drum is transferred onto a recording material such as a sheet by a transfer device.

At this time, all of the developer does not move from the surface of the photosensitive drum to the recording material by the transfer device, but some of the developer remains on the surface of the photosensitive drum. Such residual developer is recovered from the surface of the photosensitive drum by the cleaning device. Such a developer is referred to as a transfer residual toner, a remaining toner, or the like. Hereinafter, the developer remaining on the surface of the photosensitive drum after the transfer is referred to as remaining toner.

The remaining toner is recovered by the cleaning device and then stored in the remaining toner container provided in a drum cartridge. Alternatively, in general, the toner is temporarily stored in a remaining toner container and then conveyed into a remaining toner container different from the drum cartridge by a conveying portion such as a conveying screw to be stored.

In the configuration of the remaining toner container attached to the photosensitive drum, the remaining toner on the surface of the photosensitive drum is temporarily stored in a remaining toner containing portion adjacent to the photosensitive drum. Until the toner is discharged to the outside by the conveying portion provided inside the remaining toner containing portion, the remaining toner convects in the space formed between the photosensitive drum and the conveying portion due to the rotational force of the photosensitive drum.

Some of the developer contain abrasives for the purpose of actively scraping (polishing) the surface of the photosensitive drum. In the case of using such a developer, the remaining toner temporarily convecting due to the rotational force of the photosensitive drum in the space formed between the photosensitive drum and the conveying portion is in contact with the surface of the photosensitive drum and, thus, actively scrapes off the surface of the photosensitive drum.

The polishing of the surface of the photosensitive drum has the effect of suppressing the occurrence of image defect called image flow caused by electric discharge products adhered by an electric discharge phenomenon of a charging device. In order to electrically charge the surface of the photosensitive drum, the charging device is required to cause the electric discharge phenomenon in the vicinity of the charging device. It is known that, if such an electric discharge phenomenon occurs, the bonding state of the elements in the air changes, and an electric discharge product called NOx is generated.

If the electric discharge product absorbs moisture in such a state that the electric discharge product is adhered and accumulated on the surface of the photosensitive drum, the resistance of the surface of the photosensitive drum is lowered. If the surface of the photosensitive drum in a state of lowered resistance is irradiated with a laser beam, an electrostatic latent image is formed on the surface of the photosensitive drum. In this case, the boundary between the irradiated portion of the laser beam and the non-irradiated portion of the laser beam becomes ambiguous.

As a result, the electrostatic latent image becomes blurred. This phenomenon is called image flow. In order to suppress the occurrence of such image flow, it is necessary to increase the convection performance of the remaining toner in the vicinity of the opening of the remaining toner container facing the surface of the photosensitive drum and to polish the surface of the photosensitive drum by using an abrasive containing in the remaining toner.

JP 2015-028509 discloses prevention of image flow and recovery operation. JP 2015-028509 discloses a technique of detecting a density detection pattern formed on the surface of the photosensitive drum by a density sensor and polishing the surface of the photosensitive drum by an idling rotation operation or the like based on a change in density. In the idling rotation operation of JP 2015-028509, the polishing effect for the surface of the photosensitive drum by the cleaning blade is expressed.

In addition, in some cases, if the convection performance of the remaining toner in the vicinity of the opening of the remaining toner container facing the surface of the photosensitive drum is poor, paper dust contained in the remaining toner is separated in the vicinity of the remaining toner containing portion, and a paper dust layer (hereinafter, referred to as a "paper dust net") may be formed where paper dust is laminated in the vicinity of the opening. In some cases, such a paper dust net is sandwiched between a cleaning blade and the surface of the photosensitive drum, and thus, cleaning defect may occur. The occurrence of the paper dust net is suppressed by the increase in the convection performance of the remaining toner in the vicinity of the opening of the remaining toner container facing the surface of the photosensitive drum.

However, in the remaining toner conveying apparatus disclosed in JP 2015-028509, if a conveying speed is slowed in order to improve the convection performance of the remaining toner, the remaining toner is clogged in the vicinity of the discharge portion of the remaining toner. In addition, the rotation of a conveying member is hindered, and thus, there is a problem in that the conveying member is damaged.

SUMMARY OF THE INVENTION

A representative configuration of a remaining toner conveying apparatus according to the present invention includes: an introducing portion configured to introduce a developer remaining on an image bearing member without being transferred; and a conveying portion configured to convey the developer introduced by the introducing portion toward a discharge portion, the conveying portion conveying the developer so that a conveyance amount of the developer per predetermined time in a first conveyance path is equal to or less than a conveyance amount per the predetermined time of the developer in a second conveyance path which is in a downstream side of the first conveyance path in a direction of the conveying and narrower than the first conveyance path.

Further features of the present invention will become apparent from the following description of exemplary embodiments with reference to the attached drawings.

DESCRIPTION OF THE EMBODIMENTS

Embodiments of an image forming apparatus provided with a remaining toner conveying apparatus according to the invention will be described specifically with reference to the drawings.

[First Embodiment]

First, a configuration of a first embodiment of the image forming apparatus provided with the remaining toner conveying apparatus according to the invention will be described with reference to FIG. 1 to FIG. 7.

<Image Forming Apparatus>

Figure 1:
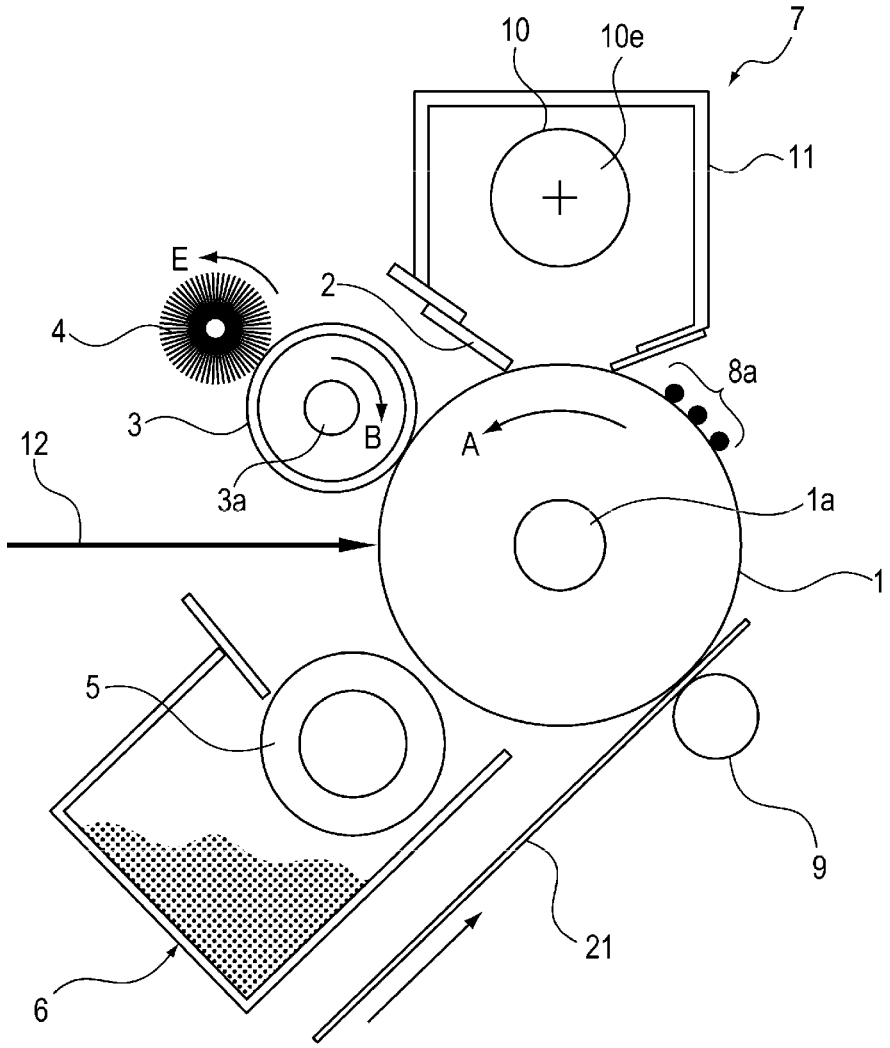
FIG. 1 is an explanatory cross-sectional diagram illustrating a configuration of an image forming apparatus according to the invention.

First, a configuration of the image forming apparatus 7 according to this embodiment will be described with reference to FIG. 1. FIG. 1 is an explanatory cross-sectional diagram illustrating a configuration of the image forming apparatus 7 according to this embodiment. The image forming apparatus 7 illustrated in FIG. 1 is configured as a copying machine, a printer, a facsimile apparatus, or a multifunction peripheral having at least two of these functions.

In the image forming apparatus 7 illustrated in FIG. 1, a photosensitive drum 1 serving as an image bearing member configured as a drum-shaped photosensitive member is rotatably supported around a rotation shaft 1*a*. With the start of an image forming operation, the photosensitive drum 1 is rotationally driven in the direction of the arrow A in FIG. 1 by the motor 22 as a driving source illustrated in FIG. 2.

The surface of the photosensitive drum 1 rotating in the direction of the arrow A in FIG. 1 is uniformly charged to a potential of a predetermined polarity by the charging roller 3 serving as a charging portion. The charging roller 3 according to this embodiment is a conductive elastic roller having a core metal having conductivity as a roller shaft body (support body) 3*a*. Then, both ends of the roller shaft body 3*a* are rotatably supported through respective bearing members. The axis line of the roller shaft body 3*a* is arranged substantially in parallel to the axis line of the rotation shaft 1*a* of the photosensitive drum 1, and the charging roller is in contact with the photosensitive drum 1 with a predetermined pressing force.

When the photosensitive drum 1 rotates in the direction of the arrow A in FIG. 1, the charging roller 3 rotates in the direction of the arrow B in FIG. 1 by a motor serving as a driving portion (not illustrated) or rotates in the direction of the arrow B in FIG. 1 by following the movement of the surface of the photosensitive drum 1. And when the charging roller 3 rotates in the direction of the arrow B in FIG. 1, a predetermined DC voltage (DC charging method) from a charging bias power supply (not illustrated) or a voltage obtained by superimposing a predetermined AC voltage on a predetermined DC voltage (AC+DC charging method) is applied as a charging bias. As a result, the surface of the photosensitive drum 1 rotating in the direction of the arrow A in FIG. 1 is uniformly charged to a potential of a predetermined polarity in a contact manner.

The surface of the uniformly charged photosensitive drum 1 is irradiated with light-modulated laser beam 12 emitted from a laser writing portion (not illustrated) serving as an image exposing portion to be exposed. As a result, an exposure bright portion of the surface of the photosensitive drum 1 is attenuated in potential, so that an electrostatic latent image corresponding to an image exposure pattern is formed. The image exposing portion may be an analog exposure apparatus which capture, projects, and exposes an image of an original or may be a digital exposure apparatus such as a laser scanner or a light emitting diode (LED) array.

The electrostatic latent image formed on the surface of the photosensitive drum 1 is supplied with a toner (developer) from a developing device 6 serving as a developing portion to be developed as a toner image. The developing device 6 according to this embodiment employs a jumping reversal developing device using a one-component magnetic toner having negative polarity as a developer. The developing device 6 is configured to include a developing sleeve 5 serving as a developer bearing member which is a rotatably driven and a hopper (not illustrated) which supplies the developer to the developing sleeve 5. The developing sleeve 5 and the surface of the photosensitive drum 1 are arranged so as to maintain a constant interval in the longitudinal direction of the photosensitive drum 1.

A voltage obtained by superimposing a predetermined AC component and a DC component from a developing bias power supply (not illustrated) is applied to the developing sleeve 5. As a result, the electrostatic latent image formed on the surface of the photosensitive drum 1 is supplied with the toner through jumping reversal by the developing device 6 to be developed as a toner image.

On the other hand, a recording material 21 is fed from a feeding unit (not illustrated), and the recording material 21 is conveyed to a transfer nip portion between the surface of the photosensitive drum 1 and a transfer roller 9 serving as a transfer portion arranged to face the photosensitive drum 1. A transfer voltage is applied from a transfer bias power supply (not illustrated) to the transfer roller 9. As a result, the toner image formed on the surface of the photosensitive drum 1 is electrostatically transferred onto the recording material 21. In addition, in some configurations, the toner image formed on the surface of the photosensitive drum 1 may be primarily transferred onto an intermediate transfer member (not illustrated), and the toner image primarily-transferred onto the intermediate transfer member may be secondarily transferred onto the recording material 21.

The transfer residual toner 8*a* adhering to the surface of the photosensitive drum 1 after the transfer of the toner image to the recording material 21 is scraped off by the cleaning blade 2 (introducing portion) serving as a cleaning portion pressed against the surface of the photosensitive drum 1 to be removed. The cleaning blade 2 is arranged along the longitudinal direction of the photosensitive drum 1 over the entire area of the image forming region R1 on the surface of the photosensitive drum 1.

Figure 2:
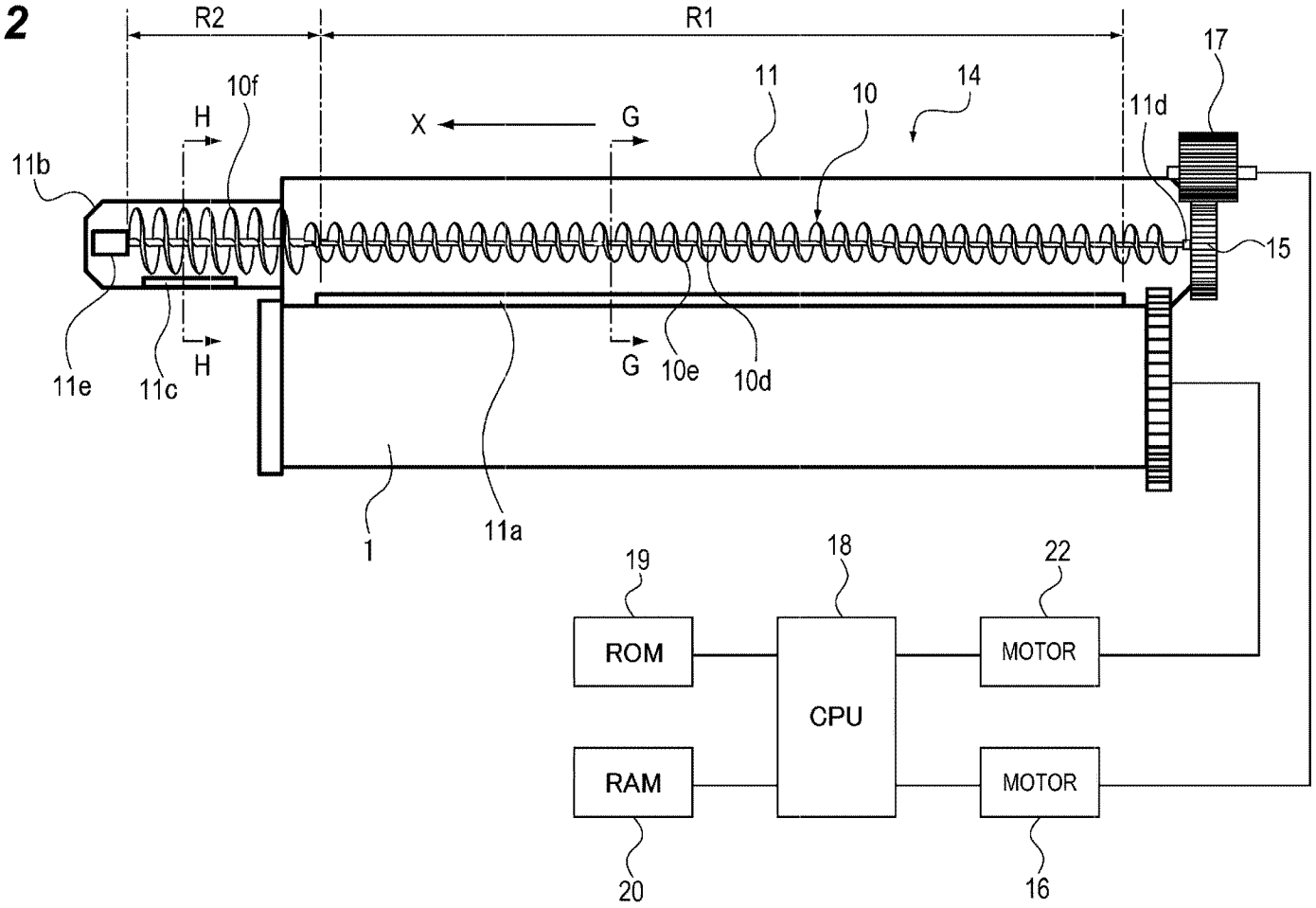
FIG. 2 is an explanatory cross-sectional diagram illustrating a configuration of a remaining toner conveying apparatus according to the first embodiment.

The remaining toner 8*b* removed by the cleaning blade 2 is recovered into the conveyance path 11 from the opening 11*a* of the conveyance path 11 arranged along the longitudinal direction of the photosensitive drum 1. After that, the remaining toner is conveyed in the conveyance path 11 by the conveying screw 10 rotatably supported in the conveyance path 11 and is discharged from a discharge outlet 11*c* of the discharge portion 11*b* provided at one end of the conveyance path 11 in the longitudinal direction thereof illustrated in FIGS. 2 and 3. The conveying screw 10 is arranged along the longitudinal direction of the photosensitive drum 1. As illustrated in FIG. 2, the conveying screw 10 is configured to have a first spiral blade 10*e* and a second spiral blade 10*f* provided on the outer circumferential surface of the rotation shaft 10*d*.

On the other hand, the recording material 21 to which the toner image has been transferred is nipped and conveyed by a fixing roller and a pressure roller provided in a fixing device serving as a fixing portion (not illustrated). In the process, the toner image is heated and pressurized to be heat-fused and heat-fixed on the recording material 21 and then discharged onto a discharge tray (not illustrated).

<Process Cartridge>

In the image forming apparatus 7 illustrated in FIG. 1, the photosensitive drum 1, the charging roller 3, and the cleaning member 4 which rotates in the direction of the arrow E in FIG. 1 to clean the surface of the charging roller 3 are rotatably supported in a unit case. Furthermore, the base end of the cleaning blade 2 is fixedly supported by the unit case. These elements are integrally provided to include a process cartridge. The process cartridge is mounted to be detachably attachable to the main body of the image forming apparatus 7.

<Recovered Material>

In general, the developer (toner) which becomes a recovered material is a magnetic resin particle. The base material of the magnetic resin particle is mainly configured with a binder resin and contains a charge control agent and magnetic powder. An external additive blended for the purpose of improving performance such as charging stability, lubricity imparting, abrasive property imparting, and scattering prevention is attached around a base material thereof.

In this embodiment, the external addition amount of strontium titanate externally added as abrasive particles for polishing the surface of the photosensitive drum 1 is preferably in a range of 0.1 parts by weight to 25 parts by weight with respect to 100 parts by weight of the toner particles. More preferably, the external addition amount of strontium titanate is preferably in a range of 2.0 parts by weight to 3.0 parts by weight with respect to 100 parts by weight of the toner particles.

If the external addition amount of strontium titanate is less than 0.1 parts by weight with respect to 100 parts by weight of the toner particles, the polishing effect cannot be sufficiently exhibited. In addition, if the external addition amount of strontium titanate exceeds 25 parts by weight with respect to 100 parts by weight of the toner particles, cohesiveness is increased. As a result, there are problems in that the developability is reduced and, due to the strong polishing effect, the photosensitive member on the surface of the photosensitive drum 1 is excessively scraped or scratched.

As the abrasive according to this embodiment, strontium titanate was used. As other similar abrasives, there may be applied oxides such as a silicon oxide, an aluminum oxide, a titanium oxide, a zinc oxide, a zirconium oxide, a chromium oxide, a cerium oxide, a tungsten oxide, an antimony oxide, a copper oxide, a tin oxide, a tellurium oxide, a manganese oxide, a boron oxide, and the like. Furthermore, there may be applied oxides such as a barium titanate, an aluminum titanate, a magnesium titanate, and a calcium titanate, carbides such as a silicon carbide, a tungsten carbide, a boron carbide, and a titanium carbide, and nitrides such as a silicon nitride, a titanium nitride and a boron nitride. Furthermore, other organic particles or the like may also be used.

The abrasive added to the toner is preferably cubic particles, which have a high polishing effect. The cubic particles have an average particle size of 30 nm to 300 nm and, more preferably, an average particle size of 40 nm to 250 nm. If the average particle size is less than 30 nm, the polishing effect of the particles in the cleaner portion is insufficient. On the other hand, if the average particle size exceeds 300 nm, the polishing effect is too strong, so that the photosensitive member on the surface of the photosensitive drum 1 is scratched, which is not suitable. In the remaining toner conveying apparatus 14 according to this embodiment, besides the magnetic remaining toner containing external additives such as the above-described abrasives, the entire powder particles may be set as recovering objects.

<Remaining Toner Conveying Apparatus>

Figure 3:
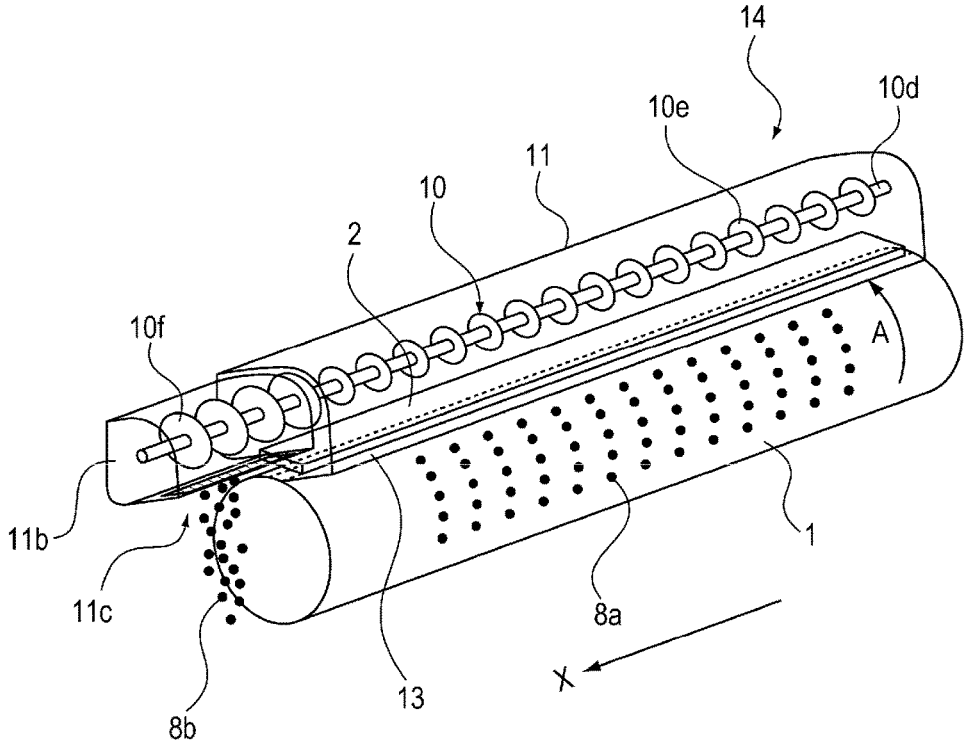
FIG. 3 is an explanatory perspective diagram illustrating a configuration of the remaining toner conveying apparatus according to the first embodiment.
Figure 4:
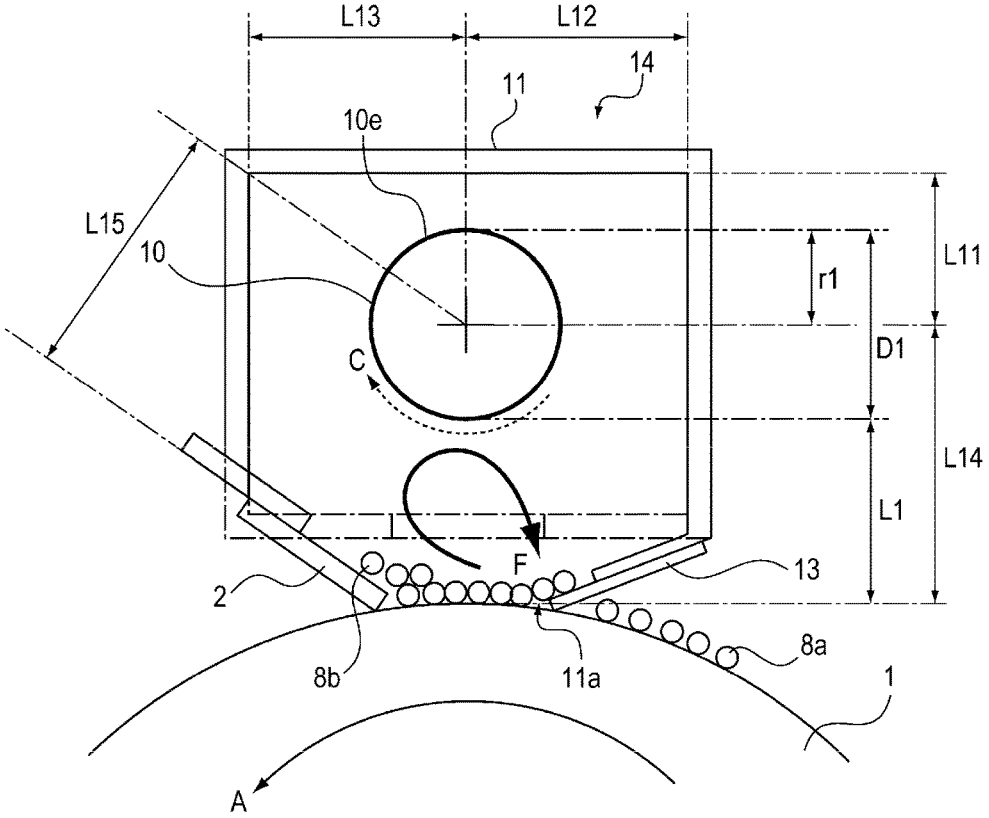
FIG. 4 is a cross-sectional view taken along line G-G in FIG. 2.
Figure 5:
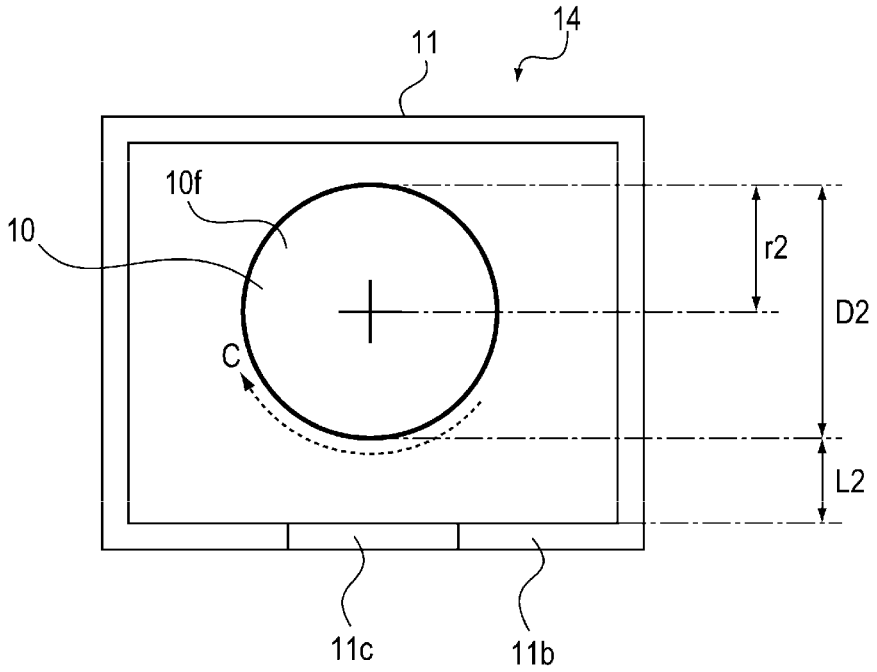
FIG. 5 is a cross-sectional view taken along line H-H of FIG. 2.
Figure 6:
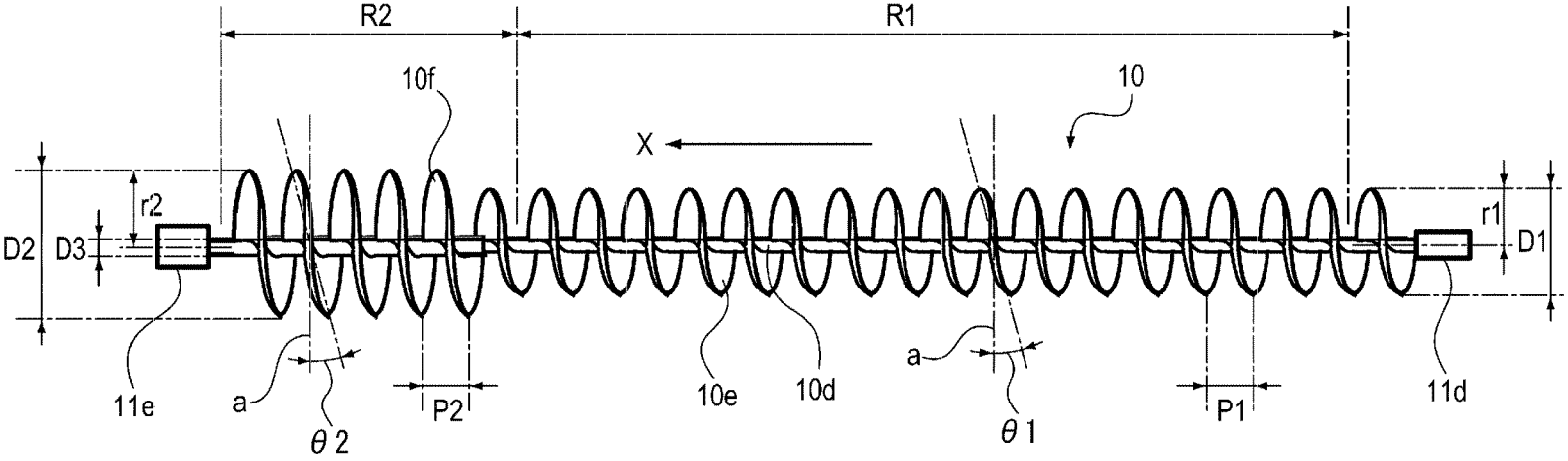
FIG. 6 is an explanatory front diagram illustrating a configuration of a conveying screw according to the first embodiment.

Next, a configuration of the remaining toner conveying apparatus 14 will be described with reference to FIGS. 2 to 6. FIG. 2 is an explanatory cross-sectional diagram illustrating the configuration of the remaining toner conveying apparatus 14 according to this embodiment. FIG. 3 is an explanatory perspective diagram illustrating the configuration of the remaining toner conveying apparatus 14 according to this embodiment. FIG. 4 is a cross-sectional view taken along line G-G in FIG. 2 and is an explanatory diagram illustrating a state of the remaining toner 8*b* in the image forming region R1 in the conveyance path 11 according to this embodiment. FIG. 5 is a cross-sectional view taken along line H-H in FIG. 2 and is an explanatory diagram illustrating a state in which the remaining toner 8*b* in the vicinity of the discharge outlet 11*c* of the discharge portion 11*b* in the downstream side in the conveyance direction of the remaining toner 8*b* of the image forming region R1 in the conveyance path 11 according to this embodiment. FIG. 6 is an explanatory front diagram illustrating the configuration of the conveying screw 10 according to this embodiment.

As illustrated in FIG. 4, the transfer residual toner 8*a* remaining on the surface of the photosensitive drum 1 after the transfer is scraped off by the cleaning blade 2 serving as a cleaning portion with the rotation of the photosensitive drum 1 in the direction of the arrow A in FIG. 4. Furthermore, the transfer residual toner is scooped up by a scooping sheet 13 provided to face the cleaning blade 2 to be recovered as the remaining toner 8*b* (toner) from the opening 11*a* of the conveyance path 11 into the conveyance path 11.

As illustrated in FIGS. 2 and 3, the conveyance path 11 is provided along the longitudinal direction of the photosensitive drum 1 to convey the remaining toner 8*b* (toner) scraped off and recovered by the cleaning blade 2 (cleaning portion). The conveying screw 10 serving as a conveying member is provided inside the conveyance path 11 (in the conveyance path) so as to be rotatable around the rotation shaft 10*d* in the direction of the arrow C in FIG. 4. The rotation shaft 10*d* of the conveying screw 10 is rotatably supported by bearings 11*d* and 11*e* provided on the wall surfaces of the conveyance path 11.

The conveying screw 10 provided inside the conveyance path 11 rotates in the direction of the arrow C in FIG. 4. As a result, the remaining toner 8*b* recovered into the conveyance path 11 is conveyed in the direction of the arrow X in FIG. 2 and discharged and stored into a recovery box (not illustrated) from the discharge outlet 11*c* of the discharge portion 11*b* provided at the longitudinal end (left side in FIGS. 2 and 3) of the conveyance path 11.

As illustrated in FIG. 2, a gear 15 is fixed to one end of the rotation shaft 10*d* of the conveying screw 10, and the gear 15 is engaged with a driving gear 17 which is rotation-driven by a motor 16 serving as a driving source. The motor 16 is driven and controlled by a central processing unit (CPU) 18 serving as a controller.

A read only memory (ROM) 19 serving as a storage portion is connected to the CPU 18. The ROM 19 stores a program or the like corresponding to a predetermined control procedure. The CPU 18 reads the program and controls each component of the image forming apparatus 7.

Furthermore, a random access memory (RAM) 20 serving as a storage portion in which working data and input data are stored is also connected to the CPU 18. The CPU 18 controls the image forming apparatus 7 with reference to the data stored in the RAM 20 based on the above-described program and the like.

<Conveying Member>

Next, a configuration of the conveying screw 10 serving as a conveying member will be described with reference to FIG. 6. As illustrated in FIG. 6, the conveying screw 10 is configured to have a first spiral blade 10*e* provided on the image forming region R1 on the surface of the photosensitive drum 1 on the outer circumferential surface of the rotation shaft 10*d*.

Furthermore, the conveying screw 10 has a second spiral blade 10*f* provided in a region R2 in the vicinity of the discharge outlet 11*c* of the discharge portion 11*b* of the conveyance path 11 in the downstream side of the first spiral blade 10*e* in the conveyance direction of the remaining toner 8*b* (downstream in the toner conveyance direction) indicated by the direction of the arrow X in FIG. 2. Herein, the image forming region R1 on the surface of the photosensitive drum 1 denotes a region on the surface of the photosensitive drum 1 which the recording material 21 having a maximum width used for the image forming apparatus 7 is in contact with.

The conveying force of the remaining toner 8*b* conveyed by the first spiral blade 10*e* of the conveying screw 10 is set to be smaller than the conveying force of the remaining toner 8*b* conveyed by the second spiral blade 10*f*. The first spiral blade 10*e* of the conveying screw 10 is provided in the image forming region R1 on the surface of the photosensitive drum 1. The second spiral blade 10*f* of the conveyance path 11 is provided in the region R2 in the vicinity of the discharge outlet 11*c* of the discharge portion 11*b*. In this embodiment, as illustrated in FIGS. 2 and 6, the outer diameter D1 of the first spiral blade 10*e* is set to be smaller than the outer diameter D2 of the second spiral blade 10*f*.

In addition, the conveying force referred to in the embodiment refers to an amount of remaining toner to be conveyed in a predetermined time.

As illustrated in FIGS. 2 and 3, the transfer residual toner 8*a* remaining on the surface of the photosensitive drum 1 after the transfer of the toner image formed on the surface of the photosensitive drum 1 to the recording material 21 is scraped off by the cleaning blade 2 illustrated in FIG. 4 with the rotation of the photosensitive drum 1 in the arrow A direction. The transfer residual toner 8*a* scraped off by the cleaning blade 2 is recovered as a remaining toner 8*b* from the opening 11*a* of the conveyance path 11 formed between the distal end of the cleaning blade 2 and the distal end of the scooping sheet 13 into the conveyance path 11. At this time, the remaining toner 8*b* convects in the direction of the arrow F in FIG. 4 in the space formed between the opening 11*a* and the outer circumferential end of the first spiral blade 10*e* due to the rotational force of the photosensitive drum 1 in the direction of the arrow A illustrated in FIG. 4.

The remaining toner 8*b* convecting in the direction of the arrow F in FIG. 4 comes into contact with the surface of the photosensitive drum 1 again. The remaining toner 8*b* contains an abrasive in advance, and the abrasive convects in the direction of the arrow F in FIG. 4 to polish the surface of the photosensitive drum 1. The conveying screw 10 (conveying portion) sets the conveying speed of the image forming region R1 (first region) illustrated in FIG. 2 to be a speed for convecting the remaining toner 8*b* (toner) recovered by the cleaning blade (introducing portion) to polish the surface of the photosensitive drum 1 (image bearing member). After that, the remaining toner 8*b* (toner) convects in the direction of the arrow F in FIG. 4 to reaches the first spiral blade 10*e* again and is conveyed in the conveyance path 11 in the direction of the arrow X in FIG. 2 by the first spiral blade 10*e*.

The remaining toner 8*b* is conveyed in the conveyance path 11 in the direction of the arrow X in FIG. 2 by the first spiral blade 10*e*. Furthermore, the remaining toner 8*b* is conveyed to the discharge outlet 11*c* of the discharge portion 11*b* by the second spiral blade 10*f* provided in the region R2 in the vicinity of the discharge outlet 11*c* of the discharge portion 11*b* of the conveyance path 11 in the downstream side of the image forming region R1. After that, the remaining toner 8*b* is discharged from the discharge outlet 11*c* into a recovery box (not illustrated).

In the conveying screw 10 illustrated in FIG. 6, the conveying force of the remaining toner 8*b* is regulated by the outer diameters D1 and D2 of the first and second spiral blades 10*e* and 10*f*. In addition, the conveying force of the remaining toner 8*b* is regulated by the separation pitches P1 and P2 of the first and second spiral blades 10*e* and 10*f* along the common rotation shaft 10*d*. In addition, the conveying force of the remaining toner 8*b* is regulated by the inclination angles θ1 and θ2 of the first and second spiral blades 10*e* and 10*f* with respect to the plane "a" perpendicular to the rotation shaft 10*d*.

Namely, the outer diameters D1 and D2 of the first and second spiral blades 10*e* and 10*f* of the conveying screw 10 illustrated in FIG. 6 are increased. Therefore, the conveying cross-sectional area of the remaining toner 8*b* conveyed by the spiral blades 10*e* and 10*f* in the direction perpendicular to the rotation shaft 10*d* of the conveying screw 10 can be increased, and circumferential velocities of the first and second spiral blades 10*e* and 10*f* becomes faster. As a result, the conveying speed and the conveyance amount of the remaining toner 8*b* in the direction of the rotation shaft 10*d* are increased. As a result, the conveying force of the remaining toner 8*b* can be set to be large. In addition, the amount of remaining toner to be conveyed is an amount of developer actually transported, as described above. Therefore, the amount varies depending on, for example, an opening area of a conveyance path (pipe or the like).

In addition, the separation pitches P1 and P2 of the first and second spiral blades 10*e* and 10*f* of the conveying screw 10 illustrated in FIG. 6 are increased. Therefore, the conveying distance of the remaining toner 8*b* conveyed by one rotation of the spiral blades 10*e* and 10*f* of the conveying screw 10 in the direction of the rotation shaft 10*d* can be increased. As a result, the conveying force of the remaining toner 8*b* can be set to be large.

In addition, the inclination angles θ1 and θ2 of the first and second spiral blades 10*e* and 10*f* of the conveying screw 10 with respect to the plane "a" perpendicular to the rotation shaft 10*d* illustrated in FIG. 6 are increased. Therefore, the conveying speed of the remaining toner 8*b* conveyed by one rotation of the spiral blades 10*e* and 10*f* of the conveying screw 10 in the direction of the rotation shaft 10*d* can be increased. As a result, the conveying force of the remaining toner 8*b* can be set to be large.

For example, the outer diameters D1 and D2 of the first and second spiral blades 10*e* and 10*f* become small. Alternatively, the separation pitches P1 and P2 of the first and second spiral blades 10*e* and 10*f* become small. Alternatively, the inclination angles θ1 and θ2 of the first and second spiral blades 10*e* and 10*f* become small. Then, the conveying force of the remaining toner 8*b* by the conveying screw 10 becomes small, and thus, the remaining toner 8*b* stays in the conveyance path 11.

Namely, the conveying screw 10 (conveying portion) conveys the remaining toner 8*b* (toner) recovered by the cleaning blade 2 (introducing portion) as follows. The remaining toner 8*b* (toner) is conveyed to the discharge portion 11*b* discharging the remaining toner 8*b* (toner) so that the conveying speed in the downstream side of the conveyance direction (left side in FIG. 2) becomes faster than the conveying speed in the upstream side of the conveyance direction (right side in FIG. 2).

In the conveying screw 10 (conveying portion), in the image forming region R1 (first region) illustrated in FIG. 2 facing the region where the toner image of the photosensitive drum 1 (image bearing member) in the cleaning blade 2 (introducing portion) is formed, the conveying speed is set as follows. The conveying speed is set to be slower than the conveying speed of the region R2 (second region) in the vicinity of the discharge outlet 11*c* of the discharge portion 11*b* of the conveyance path 11 which does not face the region where the toner image of the photosensitive drum 1 (image bearing member) in the downstream side (left side in FIG. 2) of the conveyance direction of the image forming region R1 (first region) is formed.

As a result, the conveying screw 10 (conveying portion) conveys the remaining toner 8*b* (developer) so that the conveyance amount per predetermined time in the first conveyance path conveying the remaining toner 8*b* (developer) recovered by the cleaning blade 2 (introducing portion) to the discharge portion 11*b* is equal to or less than the conveyance amount in the second conveyance path in the downstream side of the conveyance direction where the conveyance path is narrower than the first conveyance path.

As illustrated in FIG. 4, the transfer residual toner 8*a* remaining on the surface of the photosensitive drum 1 is applied with a force in the rotational direction of the photosensitive drum 1 indicated by the direction of the arrow A in FIG. 4. Then, the transfer residual toner is scraped off by the cleaning blade 2. Then, the remaining toner 8*b* is applied with the force in the rotational direction of the photosensitive drum 1 and, thus, the remaining toner has a force of rotating and convecting in the direction of the arrow F in FIG. 4 in the space formed between the opening 11*a* and the outer circumferential end of the first spiral blade 10*e* in the conveyance path 11.

By the applied rotational force of the photosensitive drum 1, the remaining toner 8*b* applied with the rotational force of the direction of the arrow F in FIG. 4 comes in contact with the surface of the photosensitive drum 1 through the opening 11*a* of the conveyance path 11 again and, thus, the surface of the photosensitive drum 1 is polished by the abrasive contained in the remaining toner 8*b*. The remaining toner 8*b* applied with the rotational force to convect in the conveyance path 11 in the direction of the arrow F in FIG. 4 is also applied with a force allowing the remaining toner to convect in the conveyance path 11 in the direction opposite to the direction of the arrow F in FIG. 4 by the first spiral blade 10*e* rotating in the direction of the arrow C in FIG. 4.

In the region R2 in the vicinity of the discharge outlet 11*c* of the discharge portion 11*b* of the conveyance path 11, the dischargeability for discharging the remaining toner 8*b* to the discharge outlet 11*c* is prioritized over the polishing effect of the surface of the photosensitive drum 1 by the remaining toner 8*b*. For this reason, preferably, various conditions of the second spiral blade 10*f* are set so that the force of convecting the remaining toner 8*b* in the conveyance path 11 in the direction opposite to the direction of the arrow F in FIG. 5 is increased by the second spiral blade 10*f* rotating in the direction of the arrow C in FIG. 5.

The transfer residual toner 8*a* remaining on the surface of the photosensitive drum 1 is scraped off by the cleaning blade 2. After that, the transfer residual toner is applied with the rotational force of the direction of the arrow A of the photosensitive drum 1 to be recovered while convecting in the direction of the arrow F in FIG. 4 from the opening 11*a* in the conveyance path 11. The remaining toner 8*b* polishes the surface of the photosensitive drum 1 and then reaches the first spiral blade 10*e*. Then, the remaining toner is conveyed in the conveyance path 11 to the discharge portion 11*b* by the first spiral blade 10*e*. After that, the remaining toner is conveyed in the discharge portion 11*b* by the second spiral blade 10*f* to be discharged from the discharge outlet 11*c* into a recovery box (not illustrated).

The outer diameter D2 of the second spiral blade 10*f* provided in the region R2 in the vicinity of the discharge outlet 11*c* of the discharge portion 11*b* of the conveyance path 11 of the conveying screw 10 illustrated in FIG. 6 is set to be large. Then, the second distance L2 between the wall surface of the discharge portion 11*b* of the conveyance path 11 and the outer circumferential end of the second spiral blade 10*f* illustrated in FIG. 5 is set to be small. As a result, the conveying force of the remaining toner 8*b* by the second spiral blade 10*f* rotating in the direction of the arrow C in FIG. 5 can be increased.

In this embodiment, the second distance L2 between the opening 11*a* of the conveyance path 11 facing the surface of the photosensitive drum 1 and the outer circumferential end of the second spiral blade 10*f* illustrated in FIG. 5 is set to be in a range of 0.8 times or more and less than 1.3 times the radius r2 (=D2/2) of the second spiral blade 10*f*.

The second distance L2 between the opening 11*a* of the conveyance path 11 and the outer circumferential end of the second spiral blade 10*f* illustrated in FIG. 5 is set to be such a numerical value that the second spiral blade 10*f* does not interfere with peripheral members such as the inner wall surface of the conveyance path 11, the cleaning blade 2, and the scooping sheet 13. In addition, the upper limit of the second distance L2 is appropriately set so that, due to the lowering of the conveying force of the remaining toner 8*b* by the second spiral blade 10*f*, the remaining toner 8*b* is not clogged in the region R2 in the vicinity of the discharge outlet 11*c* of the discharge portion 11*b* of the conveyance path 11, and thus, the conveying screw 10 is not broken.

In this embodiment, the outer diameter D2 of the second spiral blade 10*f* provided in the region R2 in the vicinity of the discharge outlet 11*c* of the discharge portion 11*b* of the conveyance path 11 is 14 mm, and the outer diameter D3 of the rotation shaft 10*d* is 5 mm. The second distance L2 between the opening 11*a* of the conveyance path 11 and the outer circumferential end of the second spiral blade 10*f* is set to be 6.05 mm. In this embodiment, the separation pitches P1 and P2 of the first and second spiral blades 10*e* and 10*f* of the conveying screw 10 along the rotation shaft 10*d* are set to be equally 10 mm.

As illustrated in FIG. 4, in this embodiment, clearances between the outer circumferential end of the first spiral blade 10*e* and inner wall surfaces of the conveyance path 11 in the image forming region R1 of the conveying screw 10 in the conveyance path 11 are as follows. A distance L11 from the center of the rotation shaft 10*d* to the upper wall surface of the conveyance path 11 is 9.04 mm. In addition, a distance L12 from the center of the rotation shaft 10*d* to the wall surface of the conveyance path 11 in the upstream side of the rotational direction of the photosensitive drum 1 in the direction of the arrow A in FIG. 4 is 8.01 mm.

A distance L13 from the center of the rotation shaft 10*d* to the wall surface of the conveyance path in the downstream side of the rotational direction of the photosensitive drum 1 is 10.98 mm. A distance L14 from the center of the rotation shaft 10*d* to the opening 11*a* of the conveyance path 11 is 13.05 mm. In addition, a distance L15 from the center of the rotation shaft 10*d* to the inner surface of the cleaning blade 2 is set to be 12.16 mm.

<Effect of Suppressing Image Flow>

The effect of suppressing the image flow in this embodiment was confirmed by using the image forming apparatus 7 which is an A3-size multi-function printer (MFP) of which the maximum size of the recording material 21 is A3 size. As the charging roller 3, an elastic solid roller having a three-layered structure of a base layer made of an elastic layer, a dielectric layer, and a protective layer is used.

The outer diameter of the charging roller 3 is 16 mm, and the Asker C hardness is 48±5°. The outer diameter of the photosensitive drum 1 is 30 mm, and the rotational speed (circumferential velocity) is 230 mm/sec. The photosensitive drum 1 is driven to be rotated by a motor 22 serving as a drive source. The driving of the motor 22 is controlled by a CPU 18 which is a controller. The number of rotations of the conveying screw 10 driven to be rotated by the motor 16 of which driving is controlled by the CPU 18 in one minute is set to be 234.3 rpm (rotation per minute).

The outer diameter D2 of the second spiral blade 10*f* provided in the region R2 in the vicinity of the discharge outlet 11*c* of the discharge portion 11*b* of the conveyance path 11 of the conveying screw 10 according to this embodiment is 14 mm. The rotational speed (circumferential velocity) V2 (mm/sec) of the second spiral blade 10*f* is expressed by the following Mathematical Formula 1. Herein, ω (rad/sec) is the angular velocity (angle per second) of the conveying screw 10. When the conveying screw 10 is rotated once, the angle is 360 degrees, that is, 2π (rad). The radius of the second spiral blade 10*f* is r2 (=D2/2).

[Mathematical Formula 1]

$$V2=\Omega\times r2$$

$$V2=234.3\ (\text{rpm})\times 2\pi/60\ (\text{sec})\times 7(\text{mm})$$

$$V2\approx 171.75\ (\text{mm/sec})$$

Therefore, the rotational speed (circumferential velocity) V2 of the second spiral blade 10*f* provided in the region R2 in the vicinity of the discharge outlet 11*c* of the discharge portion 11*b* of the conveyance path 11 of the conveying screw 10 is approximately 172 (mm/sec). The rotational speed (circumferential velocity) of the photosensitive drum 1 is 230 (mm/sec). As a result, the rotational speed (circumferential velocity) V2 of the second spiral blade 10*f* is about 0.75 times (172 (mm/sec)/230 (mm/sec)≈0.747) the rotational speed (circumferential velocity) of the photosensitive drum 1.

<Comparative Example>

As Comparative Example, the outer diameter D1 of the first spiral blade 10*e* provided in the image forming region R1 of the conveying screw 10 illustrated in FIG. 2 is equal to the outer diameter D2 of the second spiral blade 10*f* provided in the region R2 in the vicinity of the discharge outlet 11*c* of the discharge portion 11*b* of the conveyance path 11 and is set to be 14 mm.

As illustrated in FIG. 5, the transfer residual toner 8*a* remaining on the surface of the photosensitive drum 1 after the transfer is scraped off by the cleaning blade 2. In Comparative Example, it is known that the transfer residual toner is applied with a force of the rotational direction of the photosensitive drum 1 and, thus, the convection performance is deteriorated in the convection in the direction of the arrow F in FIG. 4 in the conveyance path 11 from the opening 11*a*.

As illustrated in FIG. 4, the transfer residual toner 8*a* remaining on the surface of the photosensitive drum 1 after the transfer is scraped off by the cleaning blade 2. Then, the remaining toner 8*b* is applied with the force in the rotational direction of the photosensitive drum 1 indicated by the direction of the arrow A in FIG. 4 and is recovered into the conveyance path 11 from the opening 11*a* and, thus, the remaining toner has a force of convecting in the direction of the arrow F in FIG. 4. By this force, the remaining toner 8*b* comes into contact with the surface of the photosensitive drum 1 again from the opening 11*a* of the conveyance path 11, and the surface of the photosensitive drum 1 is polished by the abrasive contained in the remaining toner 8*b*. The remaining toner 8*b* applied with the force convecting in the direction of the arrow F in FIG. 4 in the conveyance path 11 is also applied with a force in the opposite direction due to the conveying screw 10 rotating in the direction of the arrow C in FIG. 4.

It is preferable that, in the image forming region R1 illustrated in FIG. 2, the polishing effect of the surface of the photosensitive drum 1 is improved. Therefore, the occurrence of image flow caused by electric discharge products adhering to the surface of the photosensitive drum 1 can be suppressed. In addition, it is also necessary to suppress the occurrence of a phenomenon called paper dust net where the paper dust coming from the recording material 21 stays in the vicinity of the opening 11*a* of the conveyance path 11.

In order to suppress the occurrence of image flow and paper dust net, preferably the conditions of the conveying screw 10 are set so that the force of convecting the remaining toner 8*b* in the conveyance path 11 in the direction of the arrow F in FIG. 4 is not hindered. In some cases, the force of convecting the remaining toner 8*b* in the conveyance path 11 in the direction of the arrow F in FIG. 4 is hindered by the force of convecting the remaining toner 8*b*in the conveyance path 11 in the direction to the arrow C in FIG. 4 according to the rotation of the conveying screw 10 in the direction of the arrow C in FIG. 4.

In order to suppress the occurrence of image flow and paper dust net, the outer diameter D1 of the first spiral blade 10*e* provided in the image forming region R1 of the conveying screw 10 illustrated in FIG. 6 is set to be small. In addition, the first distance L1 between the opening 11*a* of the conveyance path 11 and the outer circumferential end of the first spiral blade 10*e* illustrated in FIG. 4 is set to be large. As a result, the force of convecting the remaining toner 8*b* in the conveyance path 11 in the direction of the arrow C in FIG. 4 according to the rotation of the conveying screw 10 in the direction of the arrow C in FIG. 4 can be decreased. Then, the force of convecting the remaining toner 8*b* in the conveyance path 11 in the direction of the arrow F in FIG. 4 according to the rotation of the photosensitive drum 1 in the direction of the arrow A in FIG. 4 can be increased.

In this embodiment, the outer diameter D1 of the first spiral blade 10*e* provided in the image forming region R1 of the conveying screw 10 illustrated in FIG. 6 is set to be 10 mm, and the outer diameter D3 of the rotation shaft 10*d* is set to be 5 mm. In addition, as illustrated in FIG. 4, the first distance L1 between the opening 11*a* of the conveyance path 11 and the outer circumferential end of the first spiral blade 10*e* provided in the image forming region R1 is set to be 8.05 mm.

The outer diameter D1 of the first spiral blade 10*e* provided in the image forming region R1 of the conveying screw 10 according to this embodiment is 10 mm. Similarly to Mathematical Formula 1, the rotational speed (circumferential velocity) V1 (mm/sec) of the first spiral blade 10*e* provided in the image forming region R1 is expressed by the following Mathematical Formula 2. Herein, ω (rad/sec) is the angular velocity (angle per second) of the conveying screw 10. When the conveying screw 10 is rotated once, the angle is 360 degrees, that is, 2π (rad). The radius of the first spiral blade 10*e* is denoted by r1 (=D1/2).

[Mathematical Formula 2]

$$V1=\omega\times r1$$

$$V1=234.3(\text{rpm})\times 2\pi/60(\text{sec})\times 5\ (\text{mm})$$

$$V1\approx 122.67(\text{mm/sec})$$

Therefore, the rotational speed (circumferential velocity) V1 of the first spiral blade 10*e* provided in the image forming region R1 of the conveying screw 10 is approximately 123 (mm/sec). The rotational speed (circumferential velocity) of the photosensitive drum 1 is 230 (mm/sec). As a result, the rotational speed (circumferential velocity) V1 of the first spiral blade 10*e* provided in the image forming region R1 of the conveying screw 10 is about 0.53 times (123 (mm/sec)/230 (mm/sec)≈0.534) the rotational speed (circumferential velocity) of the photosensitive drum 1.

As a result, the force of convecting the remaining toner 8*b* in the conveyance path 11 in the direction of the arrow C in FIG. 4 according to the rotation of the conveying screw 10 in the direction of the arrow C in FIG. 4 can be decreased. Then, the force of convecting the remaining toner 8*b* in the conveyance path 11 in the direction of the arrow F in FIG. 4 according to the rotation of the photosensitive drum 1 in the direction of the arrow A in FIG. 4 can be increased.

As a result, the remaining toner 8*b* comes into contact with the surface of the photosensitive drum 1 again from the opening 11*a* of the conveyance path 11, and thus, the surface of the photosensitive drum 1 is polished by the abrasive contained in the remaining toner 8*b*. Therefore, in the image forming region R1 illustrated in FIG. 2, the polishing effect on the surface of the photosensitive drum 1 can be improved. As a result, the surface of the photosensitive drum 1 is polished by the abrasive contained in the remaining toner 8*b*, and thus, the occurrence of image defects called image flow caused by electric discharge products attached by the electric discharge phenomenon of the charging roller 3 can be suppressed.

The convection performance of the remaining toner 8*b* in the image forming region R1 in the conveyance path 11 in the direction of the arrow F in FIG. 4 according to the rotation of the photosensitive drum 1 in the direction of the arrow A in FIG. 4 is set so as not to be obstruct by the rotation of the conveying screw 10 in the direction of the arrow C in FIG. 4. Therefore, the rotational speed (circumferential velocity) V1 of the first spiral blade 10*e* provided in the image forming region R1 of the conveying screw 10 is set to be in a range of at least 0.4 times or more and less than 0.6 times the rotational speed (circumferential velocity) of the photosensitive drum 1.

More preferably, the rotational speed (circumferential velocity) V1 of the first spiral blade 10*e* is set to be in a range of 0.5 times or more and less than 0.6 times the rotational speed (circumferential velocity) of the photosensitive drum 1. The outer diameter D1 of the first spiral blade 10*e* provided in the image forming region R1 of the conveying screw 10 is appropriately set so that the rotational speed (circumferential velocity) V1 of the first spiral blade 10*e* is obtained as described above.

In this embodiment, preferably, the outer diameter D1 of the first spiral blade 10*e* provided in the image forming region R1 of the conveying screw 10 is set to be in a range of 8 mm or more and less than 11 mm. More preferably, the outer diameter D1 of the first spiral blade 10*e* provided in the image forming region R1 of the conveying screw 10 is set to be in a range of 10 mm or more and less than 11 mm.

The lower limit value of the ratio between the rotational speed (circumferential velocity) V1 of the first spiral blade 10*e* provided in the image forming region R1 of the conveying screw 10 and the rotational speed (circumferential velocity) of the photosensitive drum 1 is set as follows. The lower limit value is determined from the dischargeability of the remaining toner 8*b* conveyed in the direction of the arrow X in FIG. 2 by the conveying screw 10 in the conveyance path 11. In addition, the upper limit value of the ratio between the rotational speed (circumferential velocity) V1 of the first spiral blade 10*e* and the rotational speed (circumferential velocity) of the photosensitive drum 1 is set as follows. The upper limit value of the ratio is determined by the convection performance of the remaining toner 8*b* in the image forming region R1 in the conveyance path 11 in the direction of the arrow F in FIG. 4 according to the rotation of the photosensitive drum 1 in the direction of the arrow A in FIG. 4.

Namely, the first distance L1 between the opening 11*a* facing the surface of the photosensitive drum 1 of the conveyance path 11 and the outer circumferential end of the first spiral blade 10*e* illustrated in FIG. 4 is set as follows. Preferably, the first distance L1 is set to be in a range of 1.3 times or more and less than 2.5 times the radius r1 (=D1/2) of the outer diameter D1 of the first spiral blade 10*e* provided in the image forming region R1 of the conveying screw 10.

More preferably, the first distance L1 between the opening 11*a* of the conveyance path 11 and the outer circumferential end of the first spiral blade 10*e* is set to be larger than 1.35 times or more and less than 2.0 times the radius r1 of the first spiral blade 10*e* provided in the image forming region R1.

In a case where the outer diameter D1 of the first spiral blade 10*e* provided in the image forming region R1 of the conveying screw 10 is changed from 14 mm in Comparative Example to 10 mm, a blur state of characters caused by the image flow is improved by about 15% to 20% in comparison with Comparative Example. The blur state of the characters is performed by comparing the number of black pixels when a binary process of the character image is performed.

<Comparison of Conveying Force of Remaining Toner>

Figure 7:
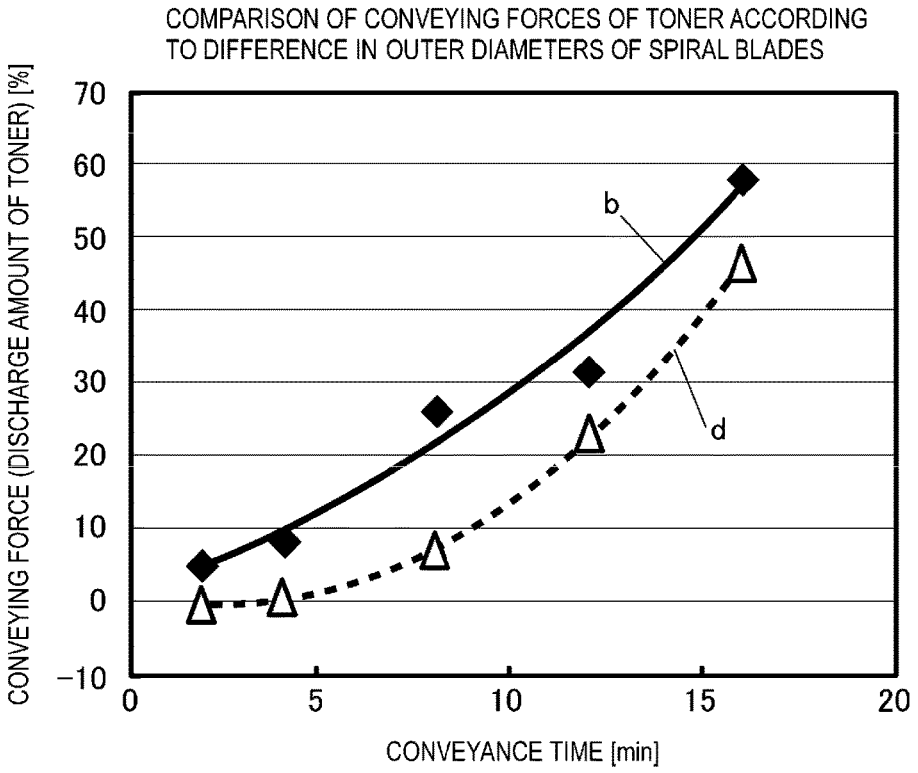
FIG. 7 is a diagram illustrating a result of comparison of conveying forces of remaining toner according to a difference in outer diameter of spiral blades of a conveying screw.

FIG. 7 illustrates a result of comparison of the conveying forces of the remaining toner 8*b* according to difference in the outer diameters D1 and D2 of the spiral blades 10*e* and 10*f* of the conveying screw 10. The graph "b" in FIG. 7 illustrates the conveying force of the remaining toner 8*b* by the remaining toner conveying apparatus 14 according to Comparative Example in which the outer diameter D1 of the first spiral blade 10*e* provided in the image forming region R1 of the conveying screw 10 is set to be 14 mm.

The graph "d" in FIG. 7 illustrates the conveying force of the remaining toner 8*b* by the remaining toner conveying apparatus 14 according to this embodiment in which the outer diameter D1 of the first spiral blade 10*e* provided in the image forming region R1 of the conveying screw 10 is set to be 10 mm. The conveying force of the remaining toner 8*b* conveyed in the conveyance path 11 is indicated by the discharge amount of the remaining toner 8*b* discharged from the discharge outlet 11*c* of the discharge portion 11*b* of the conveyance path 11.

It can be seen that the conveying force according to this embodiment (D1=10 mm) illustrated by graph "d" in FIG. 7 is decreased by 10% on average and 20% in maximum in comparison with the conveying force of Comparative Example (D1=14 mm) illustrated by graph "b" in FIG. 7. Herein, the conveying force of the remaining toner 8*b* is as follows. The amount of toner accumulated in the conveyance path 11 in a case where a certain amount of toner is fed into the conveyance path 11 in the absence of the conveying screw 10 in the conveyance path 11 is set as a reference. The ratio of weight of the remaining toner 8*b* discharged from the discharge outlet 11*c* of the discharge portion 11*b* of the conveyance path 11 when the conveying screw 10 is provided in the conveyance path 11 is calculated.

In this embodiment, as illustrated in FIG. 4, in the image forming region R1 of the photosensitive drum 1, the transfer residual toner 8*a* remaining on the surface of the photosensitive drum 1 after the transfer is scraped off by the cleaning blade 2, and the transfer residual toner is recovered as the remaining toner 8*b* from the opening 11*a* of the conveyance path 11.

The outer diameter D1 (10 mm) of the first spiral blade 10*e* of the conveying screw 10 is smaller than the outer diameter D2 (14 mm) of the second spiral blade 10*f*. The first spiral blade 10*e* is provided in the image forming region R1. The second spiral blade 10*f* of the conveyance path 11 is provided in the region R2 in the vicinity of the discharge outlet 11*c* of the discharge portion 11*b*.

The first distance L1 (8.05 mm) between the opening 11*a* of the conveyance path 11 and the outer circumferential end of the first spiral blade 10*e* provided in the image forming region R1 of the conveying screw 10 is set as follows. The first distance L1 is set to be larger than the second distance L2 (6.05 mm) between the opening 11*a* and the outer circumferential end of the second spiral blade 10*f*.

As a result, as illustrated in FIG. 4, the convection performance of the remaining toner 8*b* in the vicinity of the opening 11*a* of the conveyance path 11 in the image forming region R1 in the direction of the arrow F in FIG. 4 can be secured. As a result, the polishing of the surface of the photosensitive drum 1 being in contact with the opening 11*a* of the conveyance path 11 is facilitated by the remaining toner 8*b* containing the abrasive, and thus, the occurrence of the image flow can be suppressed. In addition, by securing the convection performance of the remaining toner 8*b* in the vicinity of the opening 11*a* of the conveyance path 11 in the direction of the arrow F in FIG. 4, it is possible to suppress the paper dust net in which the paper dust coming from the recording material 21 stays in the vicinity of the opening 11*a* of the conveyance path 11.

In addition, the outer diameter D2 (14 mm) of the second spiral blade 10*f* provided in the regions other than the image forming region R1, particularly, in the region R2 in the vicinity of the discharge outlet 11*c* of the discharge portion 11*b* of the conveyance path 11 is large. As a result, it is possible to increase the conveyability (amount of toner that can be conveyed for a predetermined time) of the remaining toner 8*b* conveyed in the discharge portion 11*b* of the conveyance path 11. As a result, the remaining toner 8*b* is not clogged in the vicinity of the discharge outlet 11*c* of the discharge portion lib, and thus, it is possible to prevent the conveying screw 10 from being broken.

In addition, if the conveyability of the remaining toner 8*b* in the region R2 in the vicinity of the discharge outlet is equal to or greater than the conveyability in the image forming region R1, clogging of the remaining toner 8*b* in the vicinity of the discharge outlet 11*c* and damage of the conveying screw 10 can be prevented.

As a result, the convection performance of the remaining toner 8*b* in the direction of the arrow F in FIG. 4 in the space formed between the surface of the photosensitive drum 1 and the outer circumferential end of the first spiral blade 10*e* provided in the image forming region R1 through the opening 11*a* of the conveyance path 11 can be improved. As a result, the polishing of the surface of the photosensitive drum 1 being in contact with the opening 11*a* of the conveyance path 11 is facilitated by the remaining toner 8*b* containing the abrasive, and thus, the occurrence of the image flow can be suppressed. In addition, the occurrence of paper dust net can also be suppressed. Furthermore, the dischargeability of the remaining toner 8*b* in the region R2 in the vicinity of the discharge outlet 11*c* of the discharge portion 11*b* of the conveyance path 11 can be maintained, and thus, clogging of the remaining toner 8*b* in the discharge portion 11*b* of the conveyance path 11 can be prevented.

In the embodiment, a conveyance amount of the remaining toner (residual toner) in a predetermined time is set as the conveying force, and the conveying force in the image forming region R1 and the conveying force in the vicinity region R2 have been described.

However, with respect to the conveying capability of a spiral blade defined by a pitch, angle, and outer diameter of the blade, the conveying capability in the vicinity region R2 may exceed the conveying capability in the image forming region R1.

This also applies to the following embodiments.

[Second Embodiment]

Figure 8:
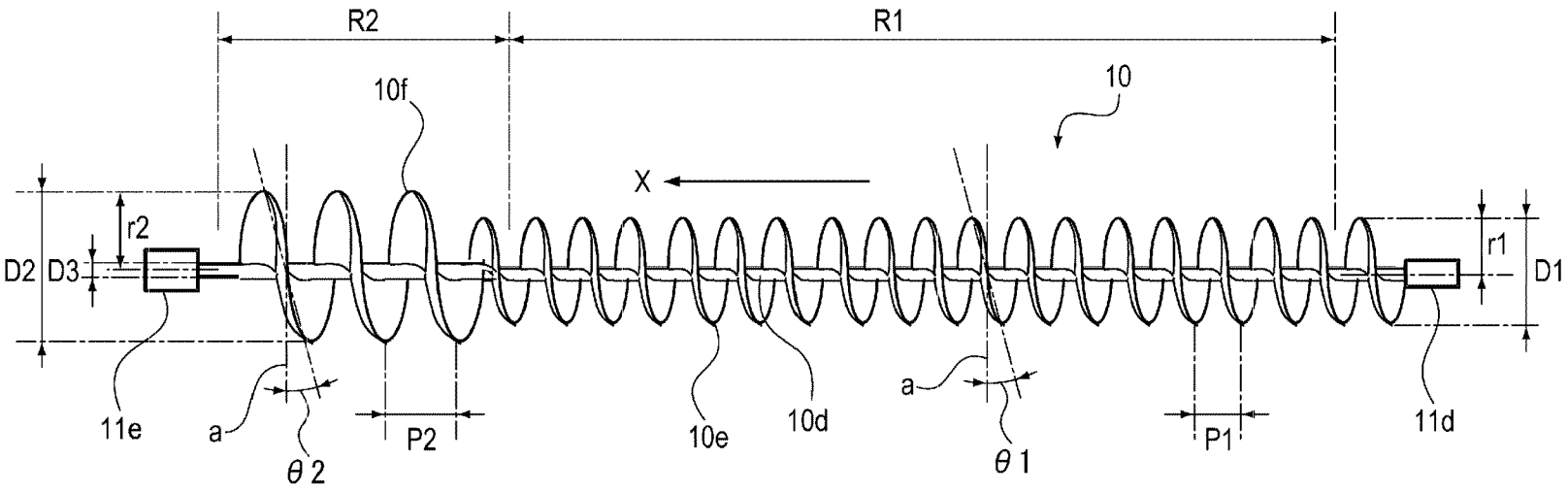
FIG. 8 is an explanatory front diagram illustrating a configuration of a conveying screw according to a second embodiment.
Figure 9:
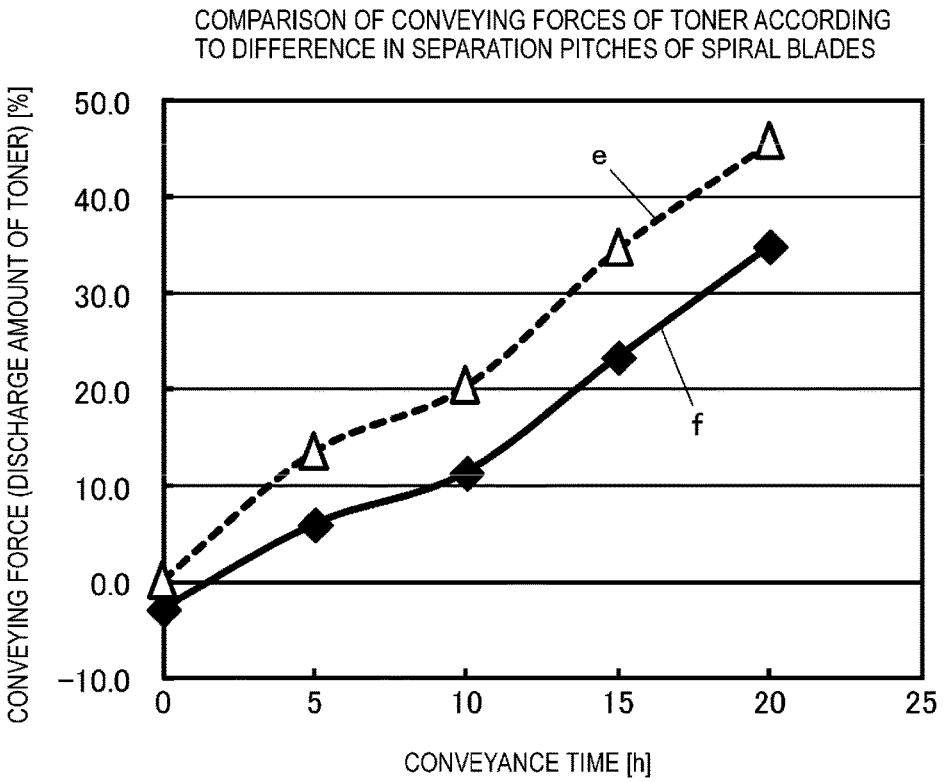
FIG. 9 is a diagram illustrating a result of comparison of conveying forces of remaining toner according to a difference in separation pitches of spiral blades of the conveying screw in a rotation shaft direction according to the second embodiment.

Next, a configuration of a second embodiment of the image forming apparatus provided with the remaining toner conveying apparatus according to the invention will be described with reference to FIGS. 8 and 9. The components configured in the same manner as in the first embodiment are denoted by the same reference numerals or by the same names with different reference numerals, and the description thereof is omitted. FIG. 8 is an explanatory front diagram illustrating the configuration of the conveying screw according to this embodiment. FIG. 9 is a diagram illustrating a result of comparison of the conveying forces of the remaining toner according to the difference in the separation pitches in the rotation shaft direction of the spiral blades of the conveying screw according to this embodiment.

In the conveying screw 10 according to the first embodiment, as illustrated in FIG. 6, the outer diameter D1 (10 mm) of the first spiral blade 10*e* provided in the image forming region R1 is set as follows. The outer diameter D1 is set to be smaller than the outer diameter D2 (14 mm) of the second spiral blade 10*f* provided in the region R2 in the vicinity of the discharge outlet 11*c* of the discharge portion 11*b* of the conveyance path 11.

Furthermore, a separation pitch P1 of the first spiral blade 10*e* provided in the image forming region R1 along the rotation shaft 10*d* and a separation pitch P2 of the second spiral blade 10*f* provided in the region R2 in the vicinity of the discharge outlet 11*c* of the discharge portion 11*b* along the rotation shaft 10*d* are set to be equally 10 mm. In this embodiment, similarly to the first embodiment, as illustrated in FIG. 8, the outer diameter D1 (10 mm) of the first spiral blade 10*e* of the conveying screw 10 is set to be smaller than the outer diameter D2 (14 mm) of the second spiral blade 10*f*.

In this embodiment, furthermore, the separation pitch P2 (20 mm) of the second spiral blade 10*f* along the rotation shaft 10*d* is set to be larger than the separation pitch P1 (10 mm) of the first spiral blade 10*e* along the rotation shaft 10*d*.

Namely, the separation pitch P1 (10 mm) of the first spiral blade 10*e* along the rotation shaft 10*d* is set to be smaller than the separation pitch P2 (20 mm) of the second spiral blade 10*f* along the rotation shaft 10*d*. As a result, in comparison with the first embodiment, the conveying force of the remaining toner 8*b* in the region R2 in the vicinity of the discharge outlet 11*c* of the discharge portion 11*b* of the conveyance path 11 can be further increased.

In addition, in this embodiment, the inclination angles θ1 and θ2 of the first and second spiral blades 10*e* and 10*f* of the conveying screw 10 with respect to the plane "a" perpendicular to the rotation shaft 10*d* illustrated in FIG. 8 are set to be equally to 15°.

In this embodiment, the separation pitch P2 of the second spiral blade 10*f* of the conveying screw 10 along the rotation shaft 10*d* is set to be large. As a result, it can be seen that the conveying force of conveying the remaining toner 8*b* in the region R2 in the vicinity of the discharge outlet 11*c* of the discharge portion 11*b* of the conveyance path 11 by the second spiral blade 10*f* in the direction of the arrow X in FIG. 2 is increased.

For example, in the related art, the separation pitch P1 of the first spiral blade 10*e* provided in the image forming region R1 along the rotation shaft 10*d* is 10 mm. The separation pitch P2 of the second spiral blade 10*f* provided in the region R2 in the vicinity of the discharge outlet 11*c* of the discharge portion 11*b* in the conveyance path 11 along the rotation shaft 10*d* is set to be 15 mm which is 1.5 times the separation pitch P1 (10 mm).

Then, it can be seen that the conveying force of conveying the remaining toner 8*b* in the direction of the arrow X in FIG. 2 by the second spiral blade 10*f* is increased by about 4% to 5% than the conveying force of conveying the remaining toner 8*b* in the direction of the arrow X in FIG. 2 by the first spiral blade 10*e*.

It is preferable that the separation pitch P2 of the second spiral blade 10*f* along the rotation shaft 10*d* is set to be 1.1 times or more and less than 2.0 times the separation pitch P1 of the first spiral blade 10*e* along the rotation shaft 10*d*.

Conversely, preferably, the separation pitch P2 of the second spiral blade 10*f* along the rotation shaft 10*d* is set to be more than 0.5 times and 0.9 times or less the first spiral blade 10*e*.

In some cases, the separation pitch P2 may be smaller than 1.0 times the separation pitch P1. In those cases, in the region R2 in the vicinity of the discharge outlet 11*c* of the discharge portion 11*b* in the conveyance path 11, a sufficient conveying force of conveying the remaining toner 8*b* in the direction of the arrow X in FIG. 2 by the second spiral blade 10*f* cannot be obtained. As a result, clogging of the remaining toner 8*b* occurs in the vicinity of the discharge outlet 11*c* of the discharge portion 11*b*, and thus, there is a problem in that the conveying screw 10 may be damaged.

Furthermore, in some cases, the separation pitch P2 may be larger than 2.0 times the separation pitch P1. In this case, the second spiral blade 10*f* idles in the remaining toner 8*b* in the region R2 in the vicinity of the discharge outlet 11*c* of the discharge portion 11*b* in the conveyance path 11. As a result, due to a decrease in conveying force, clogging of the remaining toner 8*b* may occur, and thus, the conveying screw 10 may be damaged.

In this embodiment, the separation pitch P1 of the first spiral blade 10*e* provided in the image forming region R1 of the conveying screw 10 along the rotation shaft 10*d* is set to be 10 mm. The separation pitch P2 of the second spiral blade 10*f* along the rotation shaft 10*d* is appropriately set to be 1.1 times or more and less than 2.0 times (11 mm or more and less than 20 mm) the separation pitch P1 (10 mm) of the first spiral blade 10*e*.

FIG. 9 is a diagram illustrating comparison of conveying forces of conveying the remaining toner 8*b* in the direction of the arrow X in FIG. 2 by the second spiral blade 10*f* when the separation pitch P2 of the second spiral blade 10*f* of the conveying screw 10 along the rotation shaft 10*d* is changed. In the graph "f" illustrated in FIG. 9, similarly to the first embodiment, the separation pitches P1 and P2 of the first and second spiral blades 10*e* and 10*f* of the conveying screw 10 along the rotation shaft 10*d* are set equally 10 mm. In this case, the conveying force of conveying the remaining toner 8*b* in the direction of the arrow X in FIG. 2 by the second spiral blade 10*f* is indicated by the discharge amount of the remaining toner 8*b* discharged from the discharge outlet 11*c* of the discharge portion 11*b* of the conveyance path 11.

In the graph "e" illustrated in FIG. 9, according to this embodiment, the separation pitch P1 of the first spiral blade 10*e* provided in the image forming region R1 of the conveying screw 10 along the rotation shaft 10*d* is set to be 10 mm. The separation pitch P2 of the second spiral blade 10*f* provided in the region R2 in the vicinity of the discharge outlet 11*c* of the discharge portion 11*b* in the conveyance path 11 along the rotation shaft 10*d* is set to be 20 mm. In this case, the conveying force of conveying the remaining toner 8*b* in the direction of the arrow X in FIG. 2 by the second spiral blade 10*f* is indicated by the discharge amount of the remaining toner 8*b* discharged from the discharge outlet 11*c* of the discharge portion 11*b* of the conveyance path 11.

As illustrated in FIG. 9, the graph "e" in which the separation pitch P2 of the second spiral blade 10*f* is set to be larger than the separation pitch P1 of the first spiral blade 10*e* is as follows. It can be seen that the conveying force of the remaining toner 8*b* is increased by 8% on average and 11% in maximum with respect to the graph "f" where the separation pitch P2 of the second spiral blade 10*f* is equal to the separation pitch P1 of the first spiral blade 10*e*. The other configurations are the same as those of the first embodiment, and the same effects can be obtained.

[Third Embodiment]

Figure 10:
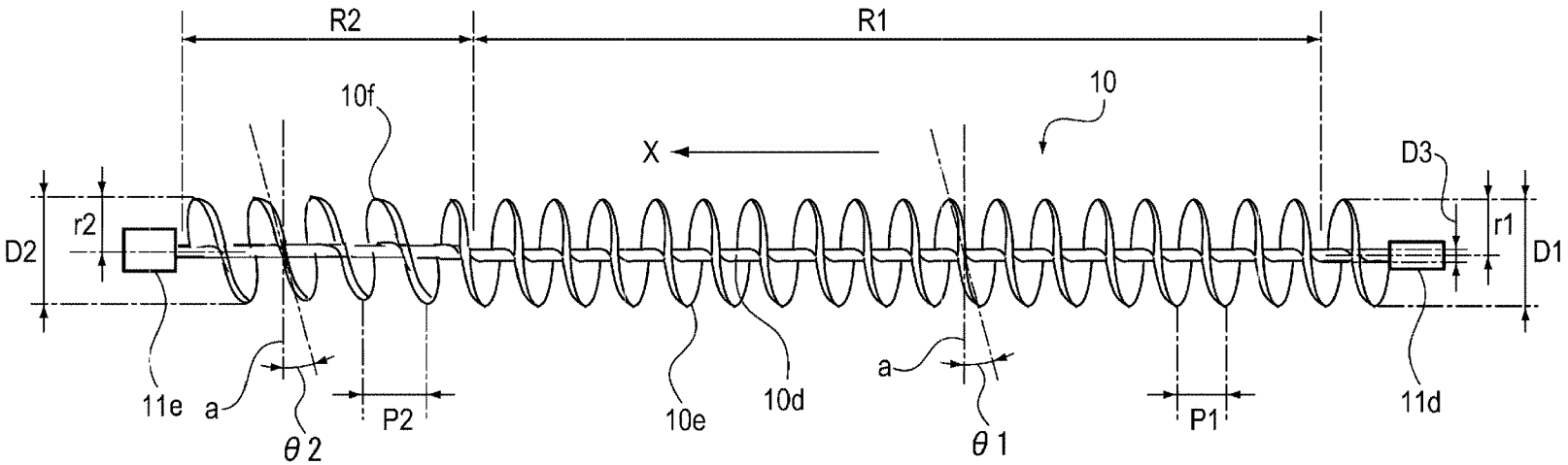
FIG. 10 is an explanatory front diagram illustrating a configuration of a conveying screw according to a third embodiment.

Next, a configuration of a third embodiment of the image forming apparatus provided with the remaining toner conveying apparatus according to the invention will be described with reference to FIG. 10. FIG. 10 is an explanatory front diagram illustrating the configuration of the conveying screw 10 according to this embodiment. The components configured in the same manner as in the first embodiment are denoted by the same reference numerals or by the same names with different reference numerals, and the description thereof is omitted. In the second embodiment, the inclination angles θ1 and θ2 of the first and second spiral blades 10*e* and 10*f* of the conveying screw 10 with respect to the plane "a" perpendicular to the rotation shaft 10*d* illustrated in FIG. 8 are set to be equally 15°.

In this embodiment, as illustrated in FIG. 10, the second inclination angle θ2 (20°) of the second spiral blade 10*f* provided in the region R2 in the vicinity of the discharge outlet 11*c* of the discharge portion 11*b* of the conveyance path 11 with respect to the plane "a" perpendicular to the rotation shaft 10*d* is set as follows. The second inclination angle θ2 is set to be larger than the first inclination angle θ1 (15°) of the first spiral blade 10*e* provided in the image forming region R1 of the conveying screw 10 with respect to the plane "a" perpendicular to the rotation shaft 10*d*.

Namely, in this embodiment, the first inclination angle θ1 (15°) of the first spiral blade 10*e* of the conveying screw 10 with respect to the plane "a" perpendicular to the rotation shaft 10*d* is set as follows. The first inclination angle θ1 is set to be smaller than the second inclination angle θ2 (20°) of the second spiral blade 10*f* with respect to the plane "a" perpendicular to the rotation shaft 10*d*.

If the first and second spiral blades 10*e* and 10*f* of the conveying screw 10 are tilted with respect to the rotation shaft 10*d*, the conveyability of the remaining toner 8*b* is increased. Therefore, in this embodiment, the second inclination angle θ2 (20°) of the second spiral blade 10*f* with respect to the plane "a" perpendicular to the rotation shaft 10*d* is set to be larger than the first inclination angle θ1 (15°) of the first spiral blade 10*e* with respect to the plane "a" perpendicular to the rotation shaft 10*d*. As a result, clogging of the remaining toner 8*b* in the vicinity of the discharge outlet 11*c* of the discharge portion 11*b* of the conveyance path 11 can be prevented.

In this embodiment, the second inclination angle θ2 of the second spiral blade 10*f* provided in the region R2 in the vicinity of the discharge outlet 11*c* of the discharge portion 11*b* of the conveyance path 11 with respect to the plane "a" perpendicular to the rotation shaft 10*d* is set to be 20°. On the other hand, the first inclination angle θ1 of the first spiral blade 10*e* provided in the image forming region R1 with respect to the plane "a" perpendicular to the rotation shaft 10*d* is set to be 15°.

As a result, the conveying speed of the remaining toner 8*b* in the direction of the arrow X in FIG. 6 by the first spiral blade 10*e* in the image forming region R1 in the conveyance path 11 can be delayed as follows. The conveying speed can be delayed to be 10% slower than the conveying speed of the remaining toner 8*b* in the direction of the arrow X in FIG. 6 by the second spiral blade 10*f* in the region R2 in the vicinity of the discharge outlet 11*c* of the discharge portion 11*b* of the conveyance path 11.

Thus, the convection time of the remaining toner 8*b* in the direction of the arrow F in FIG. 4 in the space between the surface of the photosensitive drum 1 and the conveying screw 10 in the conveyance path 11 through the opening 11*a* of the conveyance path 11 can be increased. As a result, the polishing time for the surface of the photosensitive drum 1 being in contact with the opening 11*a* of the conveyance path 11 by the remaining toner 8*b* containing the abrasive can be increased. Therefore, the occurrence of image flow can be suppressed, and the occurrence of paper dust net can be suppressed. Furthermore, it can be seen that, since the dischargeability of the remaining toner 8*b* in the region R2 in the vicinity of the discharge outlet 11*c* of the discharge portion 11*b* of the conveyance path 11 can also be maintained, clogging of the remaining toner 8*b* does not occur.

The second inclination angle θ2 of the second spiral blade 10*f* provided in the region R2 in the vicinity of the discharge outlet 11*c* of the discharge portion 11*b* of the conveyance path 11 with respect to the plane "a" perpendicular to the rotation shaft 10*d* is preferably inclined as follows. The first inclination angle θ1 of the first spiral blade 10*e* provided in the image forming region R1 is inclined with respect to the plane "a" perpendicular to the rotation shaft 10*d*. The second inclination angle θ2 is preferably greatly inclined in a range of 2° or more and less than 5° with respect to the θ1.

In this embodiment, as illustrated in FIG. 10, the outer diameter D1 (10 mm) of the first spiral blade 10*e* of the conveying screw 10 and the outer diameter D2 (10 mm) of the second spiral blade 10*f* are set to be equal to each other. Other configurations are the same as those of the above embodiments, and the same effects can be obtained.

In the embodiments described heretofore, the conveying force in the image forming region R1 and the conveying force in the vicinity region R2 have been described by setting the conveyance amount of the residual toner in the predetermined time as the conveying force.

However, as illustrated in FIG. 2, with respect to a conveying capability of the conveying portion (screw) defined by a shape such as a pitch, angle, outer diameter, and shaft thickness of a spiral blade, it is preferable that the conveying capability of the conveying portion in the image forming region R1 is set to be smaller than the conveying capability of the conveying portion in the vicinity region R2. Herein, unlike the conveyance amount, the conveying capability is a value that does not depend on the opening area of the conveyance path and the amount of the developer. As described above, by setting the conveying capability in the region R1 and the conveying capability in the region R2, the conveying speed of the developer in the region R1 by the conveying portion can be set to be slower, so that it is possible to sufficiently polish the image bearing member with the developer. On the other hand, in the region R2, the conveying of the developer by the conveying portion can be speeded up without clogging the developer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-110786, filed Jun. 2, 2016 which is hereby incorporated by reference herein in its entirety.

What is claimed is:

1. A remaining toner conveying apparatus comprising:

an introducing portion configured to introduce a developer remaining on an image bearing member without being transferred; and a conveying portion configured to convey the developer introduced by the introducing portion toward a discharge portion, the conveying portion conveying the developer so that a conveyance amount of the developer per predetermined time in a first conveyance path is less than a conveyance amount per the predetermined time of the developer in a second conveyance path which is downstream of the first conveyance path in a direction of the conveying, wherein the conveying portion is configured such that a conveying speed of the developer in the first conveyance path is a speed for conveying the toner introduced by the introducing portion and polishing the surface of the image bearing member.

2. The remaining toner conveying apparatus according to claim 1, wherein the conveying portion is configured such that the first conveyance path is provided to face a first region where a toner image of the image bearing member is formed, and the second conveyance path is provided downstream of the first region in the conveyance direction to face a second region where the toner image is not formed.

3. The remaining toner conveying apparatus according to claim 1, wherein the conveying portion is configured with a spiral blade.

4. The remaining toner conveying apparatus according to claim 3, wherein an outer diameter of the spiral blade in the first conveyance path is set to be smaller than an outer diameter of the spiral blade in the second conveyance path.

5. The remaining toner conveying apparatus according to claim 4, wherein a distance between an opening facing the image bearing member and the outer circumferential end of the spiral blade in the first conveyance path is set to be 1.3 times or more and less than 2.5 times a radius of the spiral blade in the first conveyance path, and wherein a distance between the opening facing the image bearing member and the outer circumferential end of the spiral blade in the second conveyance path is set to be 0.8 times or more and less than 1.3 times a radius of the spiral blade in the second conveyance path.

6. The remaining toner conveying apparatus according to claim 3, wherein a separation pitch of the spiral blade in the first conveyance path along a rotation shaft is set to be smaller than a separation pitch of the spiral blade in the second conveyance path along the rotation shaft.

7. The remaining toner conveying apparatus according to claim 6, wherein the separation pitch in the first conveyance path is set to be in a range of more than 0.5 times and 0.9 times or less the separation pitch in the second conveyance path.

8. The remaining toner conveying apparatus according to claim 3, wherein an inclination angle of the spiral blade in the first conveyance path with respect to a plane perpendicular to a rotation shaft is set to be smaller than the inclination angle in the second conveyance path.

9. The remaining toner conveying apparatus according to claim 8, wherein the inclination angle in the first conveyance path is set to be smaller in a range of 2° or more and less than 5° than the inclination angle in the second conveyance path.

10. An image forming apparatus comprising:

an image bearing member; and the remaining toner conveying apparatus according to claim 1.

11. A remaining toner conveying apparatus comprising:

an image bearing member configured to bear a toner image on a surface thereof;

a collecting inlet configured to collect remaining toner which remains on the surface of the image bearing member without being transferred to a recording medium;

a first conveying portion disposed at an area facing a toner image forming area of the image bearing member and configured to convey an amount of the remaining toner collected by the collecting inlet exceeding a predetermined amount, the first conveying portion polishing the toner image forming area with the remaining toner by conveying the remaining toner; and a second conveying portion disposed at another area not facing the toner image forming area downstream of the first conveying portion in a conveying direction of the remaining toner and having a greater capability of conveying the remaining toner than the first conveying portion.

12. The remaining toner conveying apparatus according to claim 11, wherein the first and second conveying portions are configured with a spiral blade.

13. The remaining toner conveying apparatus according to claim 12, wherein an outer diameter of the spiral blade in the first conveying portion is smaller than an outer diameter of the spiral blade in the second conveying portion.

14. The remaining toner conveying apparatus according to claim 13, wherein a distance between the collecting inlet facing the image bearing member and an outer circumferential end of the spiral blade in the first conveying portion is set to be 1.3 times or more and less than 2.5 times a radius of the spiral blade in the first conveying portion, and wherein a distance between the collecting inlet facing the image bearing member and the outer circumferential end of the spiral blade in the second conveying portion is set to be 0.8times or more and less than 1.3 times a radius of the spiral blade in the second conveying portion.

* * * * *